US009630194B1

(12) United States Patent
Matson

(10) Patent No.: US 9,630,194 B1
(45) Date of Patent: Apr. 25, 2017

(54) PRODUCT APPLICATOR SYSTEM

(71) Applicant: David R. Matson, Cooperstown, ND (US)

(72) Inventor: David R. Matson, Cooperstown, ND (US)

( * ) Notice: Subject to any disclaimer, the term of this patent is extended or adjusted under 35 U.S.C. 154(b) by 0 days.

(21) Appl. No.: 14/952,477

(22) Filed: Nov. 25, 2015

(51) Int. Cl.

| | |
|---|---|
| ***B05B 3/02*** | (2006.01) |
| ***B05B 3/14*** | (2006.01) |
| ***B05B 3/00*** | (2006.01) |
| ***B05B 7/02*** | (2006.01) |

(52) U.S. Cl.
CPC . *B05B 3/02* (2013.01); *B05B 7/02* (2013.01)

(58) Field of Classification Search
CPC B05B 3/02; B05B 3/025; B05B 3/026; B05B 3/027; B05B 3/028; B05B 3/10; B05B 3/1007; B05B 3/1014; B05B 3/1035; B05B 3/1042; B05B 3/1057; B05B 3/1064; B05B 3/1071; B05B 3/1078; B05B 3/12; B05B 3/14; B05B 7/02
See application file for complete search history.

(56) References Cited

U.S. PATENT DOCUMENTS

| | | | | |
|---|---|---|---|---|
| 3,379,379 | A * | 4/1968 | Orem | B05B 3/16 239/227 |
| 3,506,195 | A | 4/1970 | Waldrum | |
| 3,655,130 | A | 4/1972 | Patrick | |
| 4,272,019 | A | 6/1981 | Halaby | |
| 4,561,592 | A * | 12/1985 | Fender | B05B 13/0431 239/587.2 |
| 4,760,963 | A | 8/1988 | Waldrum | |
| 4,768,715 | A | 9/1988 | Sali | |
| 5,167,369 | A | 12/1992 | Kubacek | |
| 5,890,656 | A * | 4/1999 | Fuhlbrigge | F04C 15/0061 239/225.1 |
| 7,178,743 | B2 | 2/2007 | Clarke, III | |
| 7,547,364 | B2 | 6/2009 | Polak | |
| 8,276,832 | B2 | 10/2012 | Nelson | |
| 8,302,882 | B2 | 11/2012 | Nelson | |
| 2012/0298772 | A1 * | 11/2012 | Stammen | B05B 13/0468 239/243 |

* cited by examiner

*Primary Examiner* — Darren W Gorman
(74) *Attorney, Agent, or Firm* — Neustel Law Offices; Michael S. Neustel

(57) ABSTRACT

A product applicator system for distributing a liquid product accurately using low volume applications which minimize the quantity of product used and ensures more accurate results. The product applicator system generally includes a housing which includes a removable inlet port mount and outlet port mount. The positioning of the inlet and outlet port mounts on the housing is interchangeable. Supply hoses provide a product to the inlet port mount where the product is traversed through internal conduits to exit the housing via oscillating and overlapping spray heads. An internal motor provides oscillating motion to the spray heads. A rotator assembly which includes a rotator motor may be utilized to orient the housing in horizontal, vertical, or various diagonal orientations. The housing is adapted to either connect to a vehicle, be positioned on a stationary or movable platform, or be connected to a boom using boom connectors.

18 Claims, 15 Drawing Sheets

PRODUCT APPLICATOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a dispensing system and more specifically it relates to a product applicator system for distributing a liquid product accurately using low volume applications which minimize the quantity of product used and ensures more accurate results.

Description of the Related Art

Any discussion of the related art throughout the specification should in no way be considered as an admission that such related art is widely known or forms part of common general knowledge in the field.

Controlled application of products such as herbicides, paints, water, and the like is a major concern for a wide range of businesses. For example, railroads utilize egress spraying of rights-of-ways, yards, crossings, material piles, fixtures, buildings, and the like. Airports utilize sprayers for runway lights, open fields, fence lines, hanger areas, etc. Roadside vegetating control and chemical salting also relies on controlled application of liquid products (pesticides) and solid products (salt). The agriculture industry utilizes controlled application of various products for weed abatement and the like. Various other industries also utilize controlled application of products (liquid or solid) as well.

In the past, the controlled application of such products has been limited. Lack of control of application may result in higher volume of product used or reduction of accuracy in application of the product. The use of excessive product is both inefficient from a cost perspective but also can lead to environmental concerns if the application of the product is not tightly controlled, particularly near waterways and the like.

Because of the inherent problems with the related art, there is a need for a new and improved product applicator system for distributing a liquid product accurately using low volume applications which minimize the quantity of product used and ensures more accurate results.

BRIEF SUMMARY OF THE INVENTION

The invention generally relates to a product applicator which includes a housing which includes a removable inlet port mount and outlet port mount. The positioning of the inlet and outlet port mounts on the housing is interchangeable. Supply hoses provide a product to the inlet port mount where the product is traversed through internal conduits to exit the housing via oscillating and overlapping spray heads. An internal motor provides oscillating motion to the spray heads. A rotator assembly which includes a rotator motor may be utilized to orient the housing in horizontal, vertical, or various diagonal orientations. The housing is adapted to either connect to a vehicle, be positioned on a stationary or movable platform, or be connected to a boom using boom connectors.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
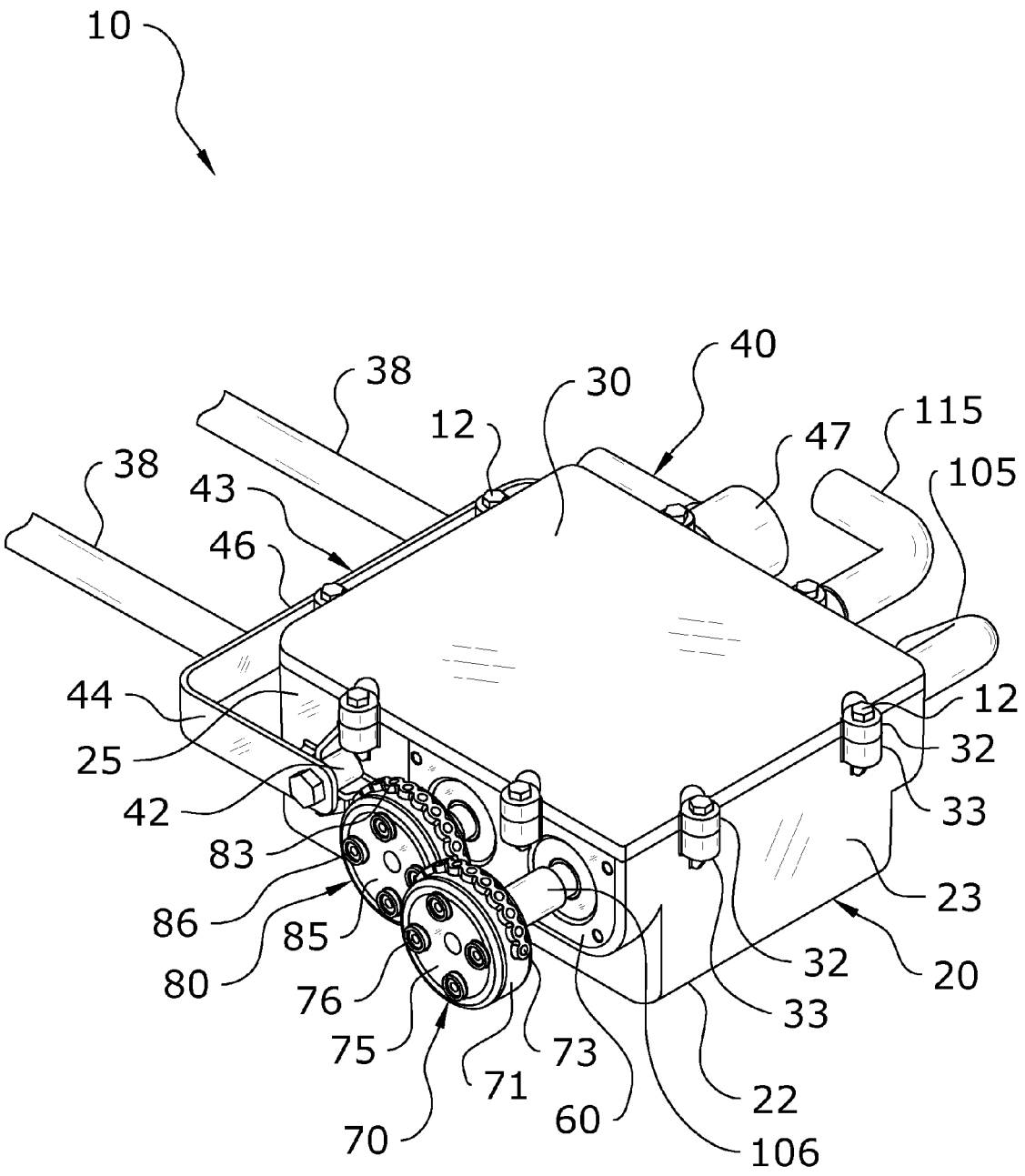
FIG. 1 is a first upper perspective view of the present invention.

Turning now descriptively to the drawings, in which similar reference characters denote similar elements throughout the several views, FIGS. 1 through 15 illustrate a product applicator system 10, which comprises a housing 20 which includes a removable inlet port mount 50 and outlet port mount 60. The positioning of the inlet and outlet port mounts 50, 60 on the housing 20 is interchangeable. Supply hoses 105, 115 provide a product to the inlet port mount 50 where the product is traversed through internal conduits 100, 110 to exit the housing 20 via oscillating and overlapping spray heads 70, 80. An internal motor 91 provides oscillating motion to the spray heads 70, 80. A rotator assembly 40 which includes a rotator motor 47 may be utilized to orient the housing 20 in horizontal, vertical, or various diagonal orientations. The housing 20 is adapted to either connect to a vehicle, be positioned on a stationary or movable platform, or be connected to a boom using boom connectors 38.

B. Housing

As shown throughout the figures, the present invention includes a housing 20 which contains the various components of the present invention. The housing 20 is adapted to either be mounted to a vehicle, such as farming equipment or any other type of vehicle, or be positioned at a location to be treated. Although the figures illustrate a substantially rectangular housing 20, it should be appreciated that the housing 20 may comprise various other shapes and dimensions, and thus should not be limited in scope by the exemplary figures.

Figure 2:
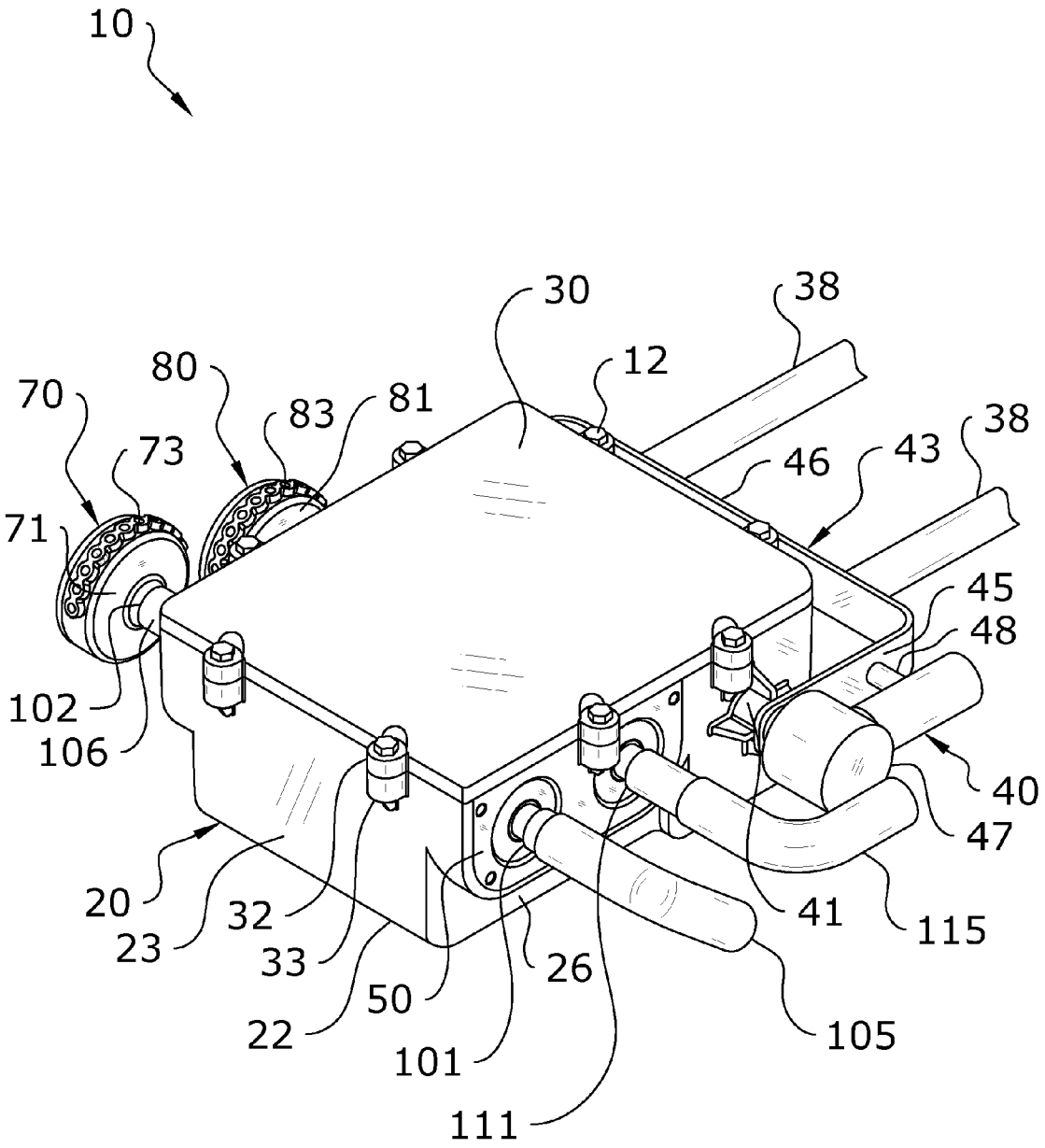
FIG. 2 is a second upper perspective view of the present invention.
Figure 3:
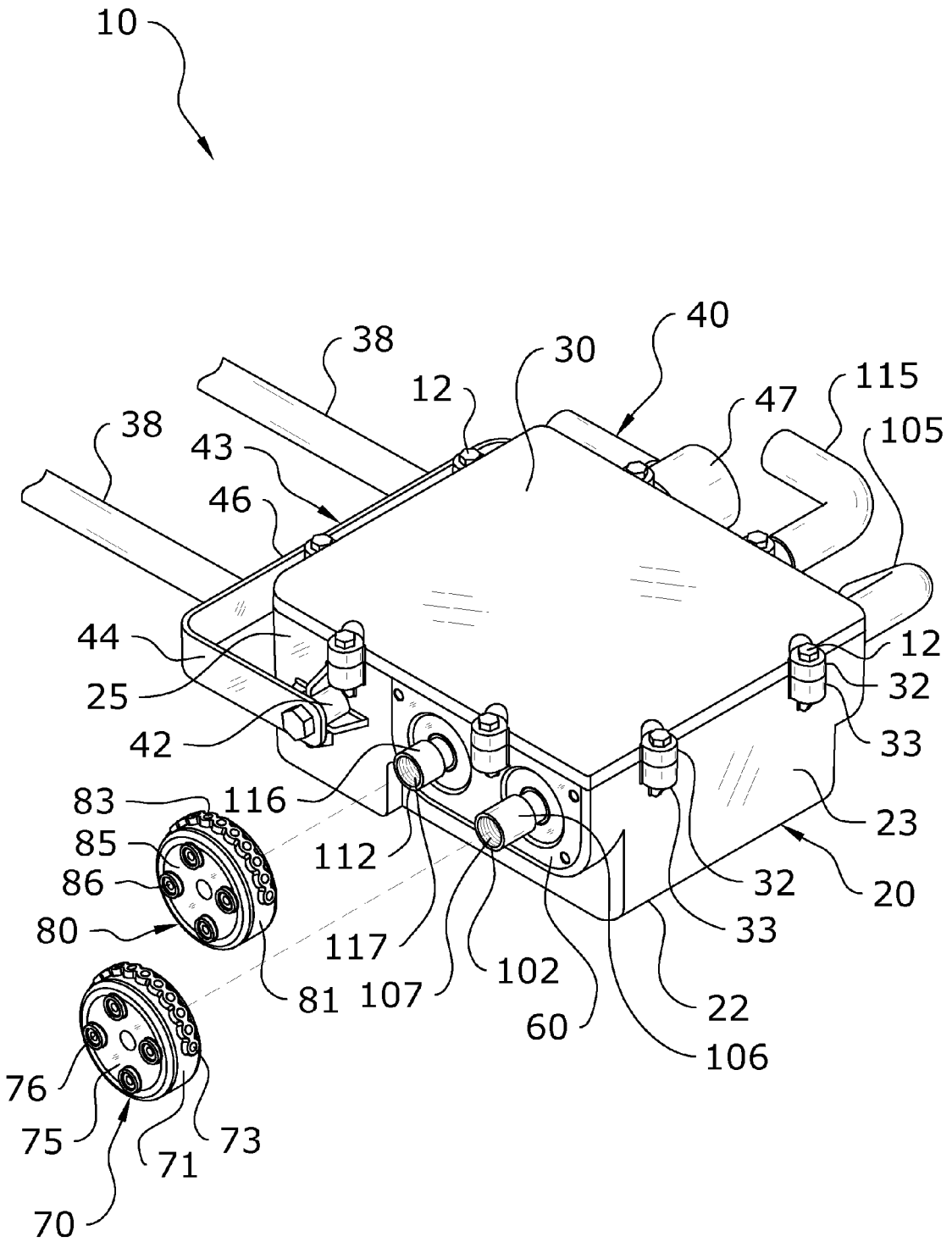
FIG. 3 is an upper perspective view of the present invention with spray heads removed.

The housing 20 is best shown in FIGS. 1-3. As illustrated therein, the housing 20 generally includes an upper end 21, a lower end 22, a front end 23, a rear end 24, a first side 25, and a second side 26. The upper end 21 of the housing 20 provides access to a cavity 27 within the housing 20 in which various components of the present invention, such as the motor 91 and internal conduits 100, 110, are positioned. The upper end 21 of the housing 20 may also include one or more housing connectors 33 which are utilized to removably secure a lid 30 over the upper end 21 of the housing 20 to enclose the cavity 27.

Figure 6:
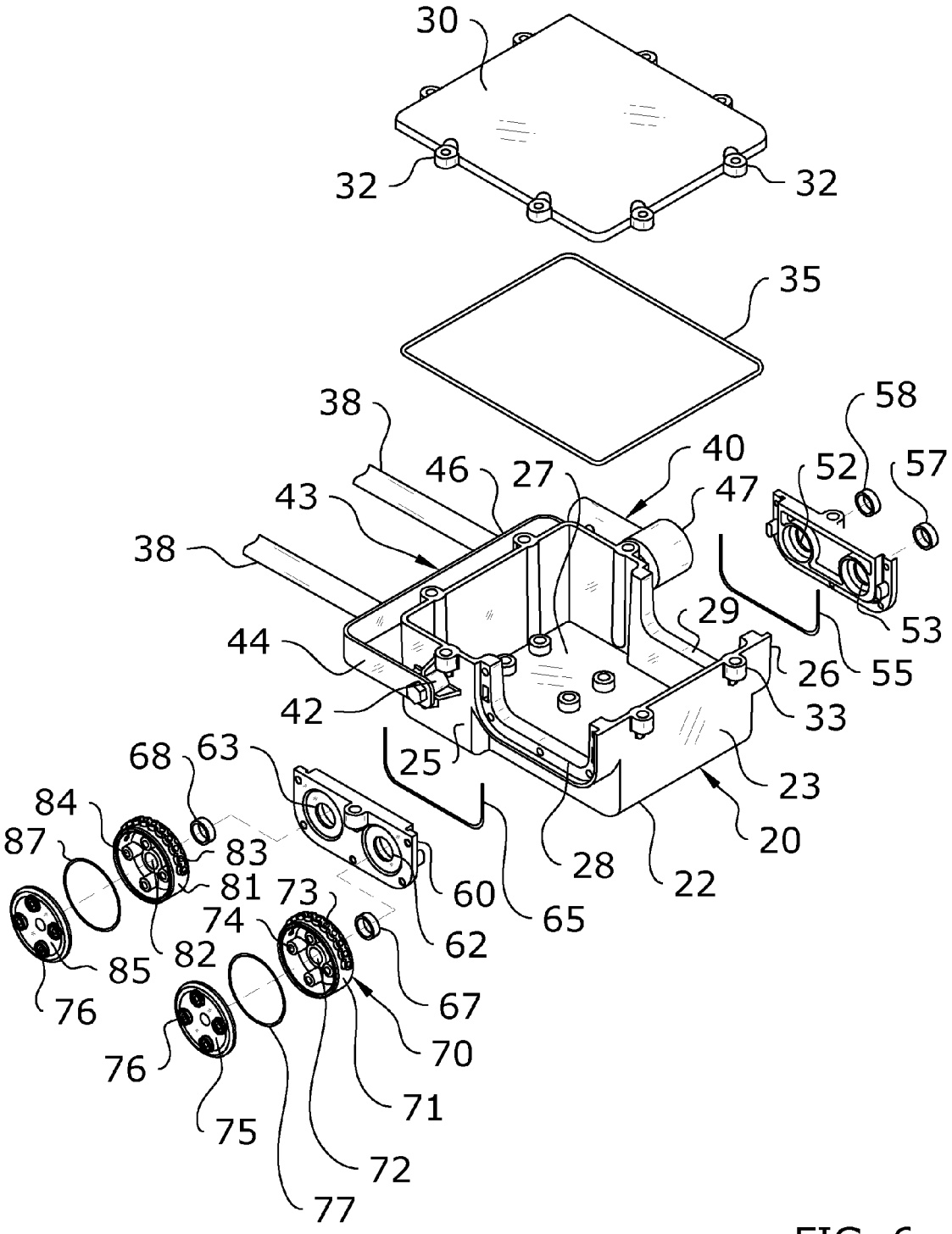
FIG. 6 is an exploded upper perspective view of the housing of the present invention.

As best shown in FIG. 6, the first side 25 of the housing 20 may include a first receiver opening 28 and the second side 26 of the housing 20 may include a second receiver opening 29. The receiver openings 28, 29 are adapted to removably receive port mounts 50, 60 of the present invention. By selectively and removably securing the port mounts 50, 60 within the receiver openings 28, 29, the direction of spray (i.e. the inlet side and the outlet side) from the housing 20 may be altered.

The shape, size, positioning, and orientation of the receiver openings 28, 29 may vary in different embodiments. The figures illustrate an exemplary embodiment of the receiver openings 28, 29 which should not be construed as limiting on the scope of their configuration. Any type of receiver opening 28, 29 will function so long as the port mounts 50, 60 are adapted to be removably secured therein. In some embodiments, receiver openings 28, 29 may be omitted entirely, with the port mounts 50, 60 being integral with the housing 20. However, this type of configuration does limit the ability to interchange spray direction.

Figure 4:
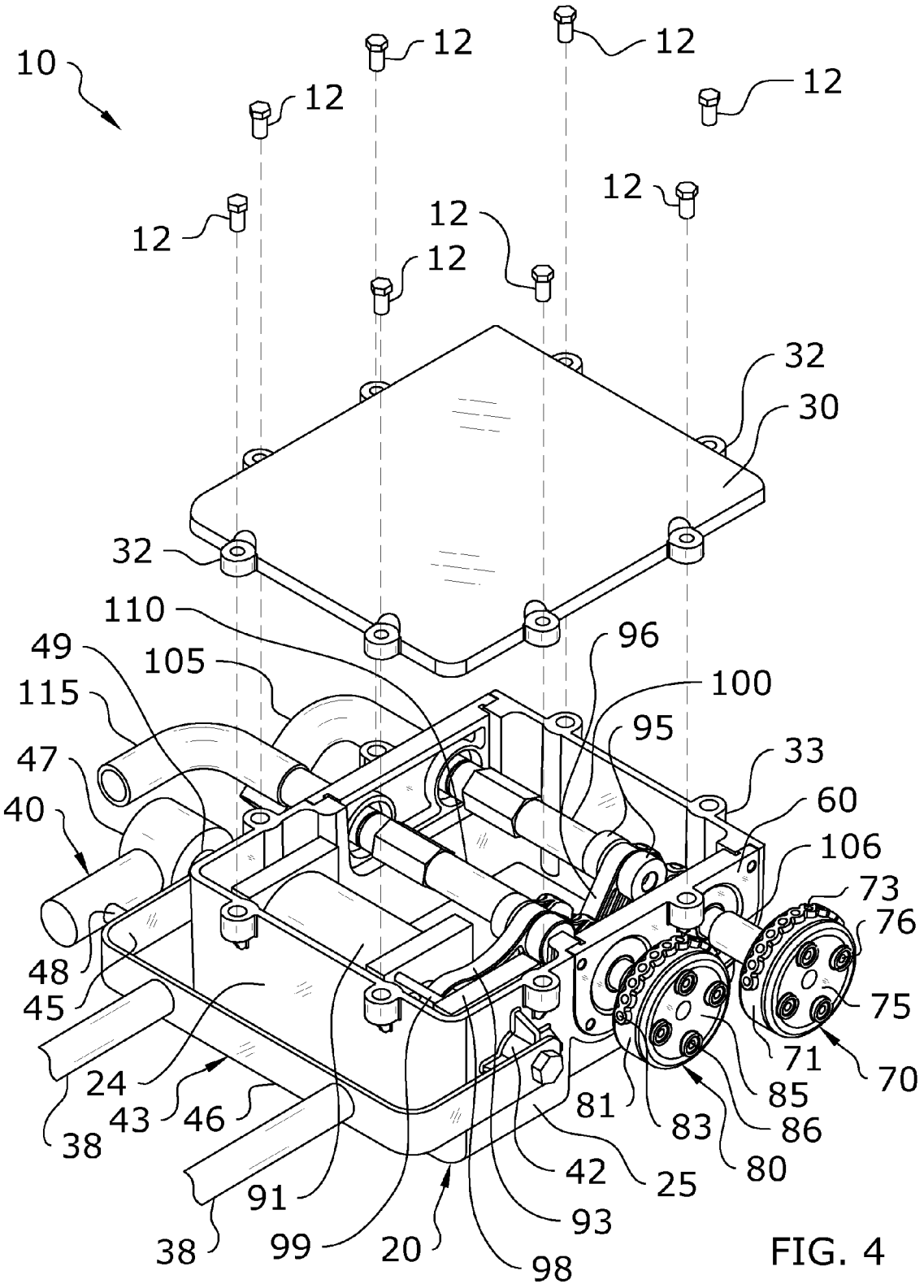
FIG. 4 is an upper perspective view of the present invention with the lid removed.

As best shown in FIG. 4, the housing 20 generally includes a removable lid 30 which may be removably secured to the upper end 21 of the housing 20 to selectively enclose the cavity 27 within. The lid 30 will generally be secured on the housing 20 when the present invention is in use or storage, and removed when repairing or replacing internal components or when switching the port mounts 50, 60.

Figure 5:
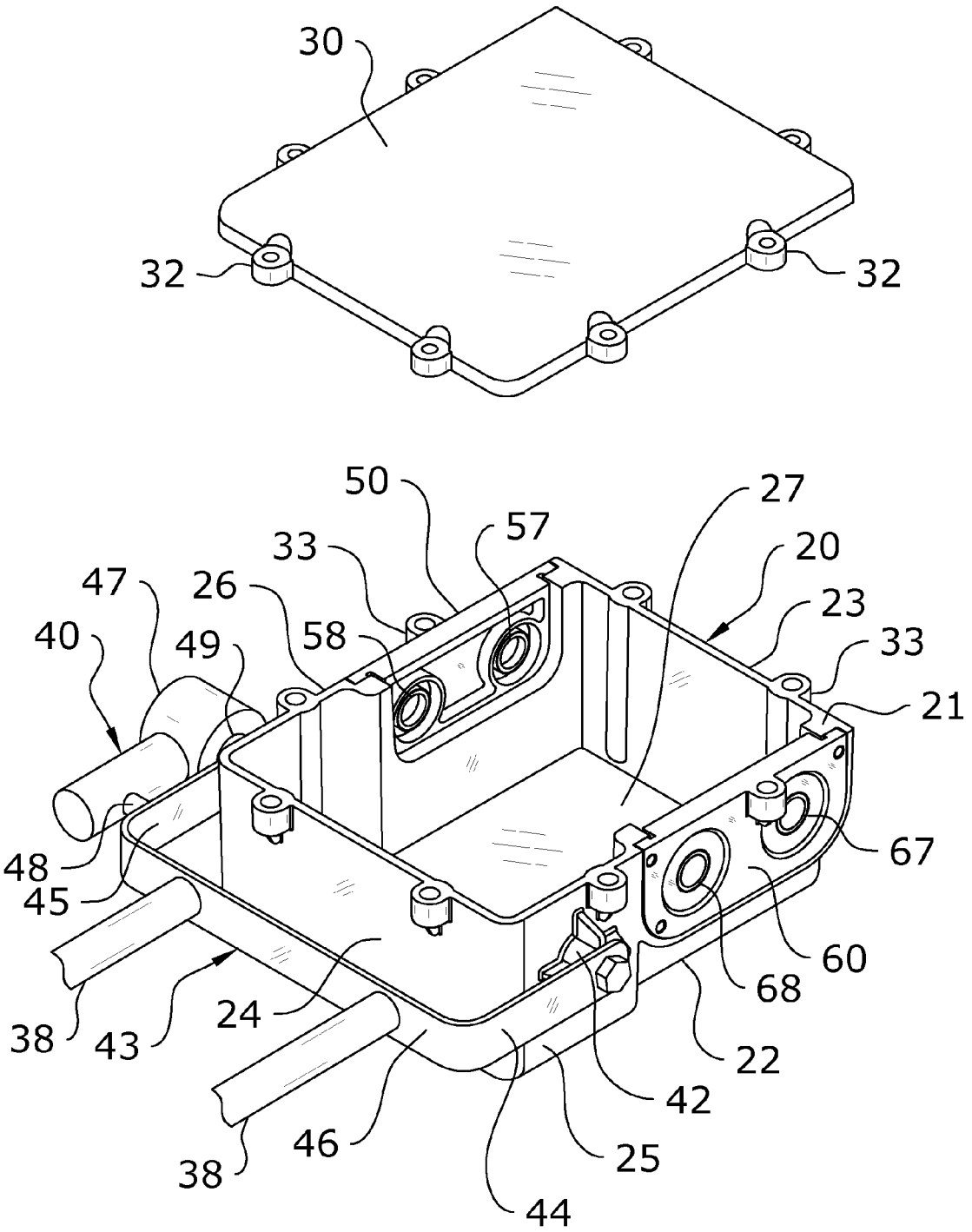
FIG. 5 is an upper perspective view of the present invention with the lid and internal conduits removed.

To removably secure the lid 30 to the housing 20, the lid 30 may include one or more lid connectors 32 such as shown in FIG. 5. The lid connectors 32 are adapted to removably secure to the corresponding housing connectors 33 of the housing 20 to removably secure the lid 30. The connectors 32, 33 may comprise any device, structure, assembly, sub-assembly or the like which may be utilized to removably secure the lid 30 to the housing 20. By way of example and without limitation, the connectors 32, 33 could in some embodiments comprise clasps, brackets, tabs, hooks, or the like. In some embodiments, fasteners 12 may be utilized to secure the lid connectors 32 to the housing connectors 33. In other embodiments, connectors 32, 33 may be omitted entirely, with the lid 30 frictionally engaging with the housing 20.

To prevent water intrusion or water escape within the housing 20, the cavity 27 of the housing 20 will preferably be sealed. To seal the interconnection between the housing 20 and the lid 30, a lid seal 35 may be secured between the upper end 21 of the housing 20 and the lid 30 such as shown in FIG. 6. Various types of seals 35 may be utilized and the exemplary lid seal 35 illustrated in the figures should not be construed as limiting on the scope of the present invention. In the embodiment shown in FIG. 6, the lid seal 35 comprises a rectangular seal to match the shape of the housing 20 and lid 30. In embodiments in which the housing 20 and/or lid 30 are differently-shaped, the lid seal 35 will generally comprise a different shape to match that of the housing 20 and/or lid 30.

C. Rotator Assembly

Figure 12:
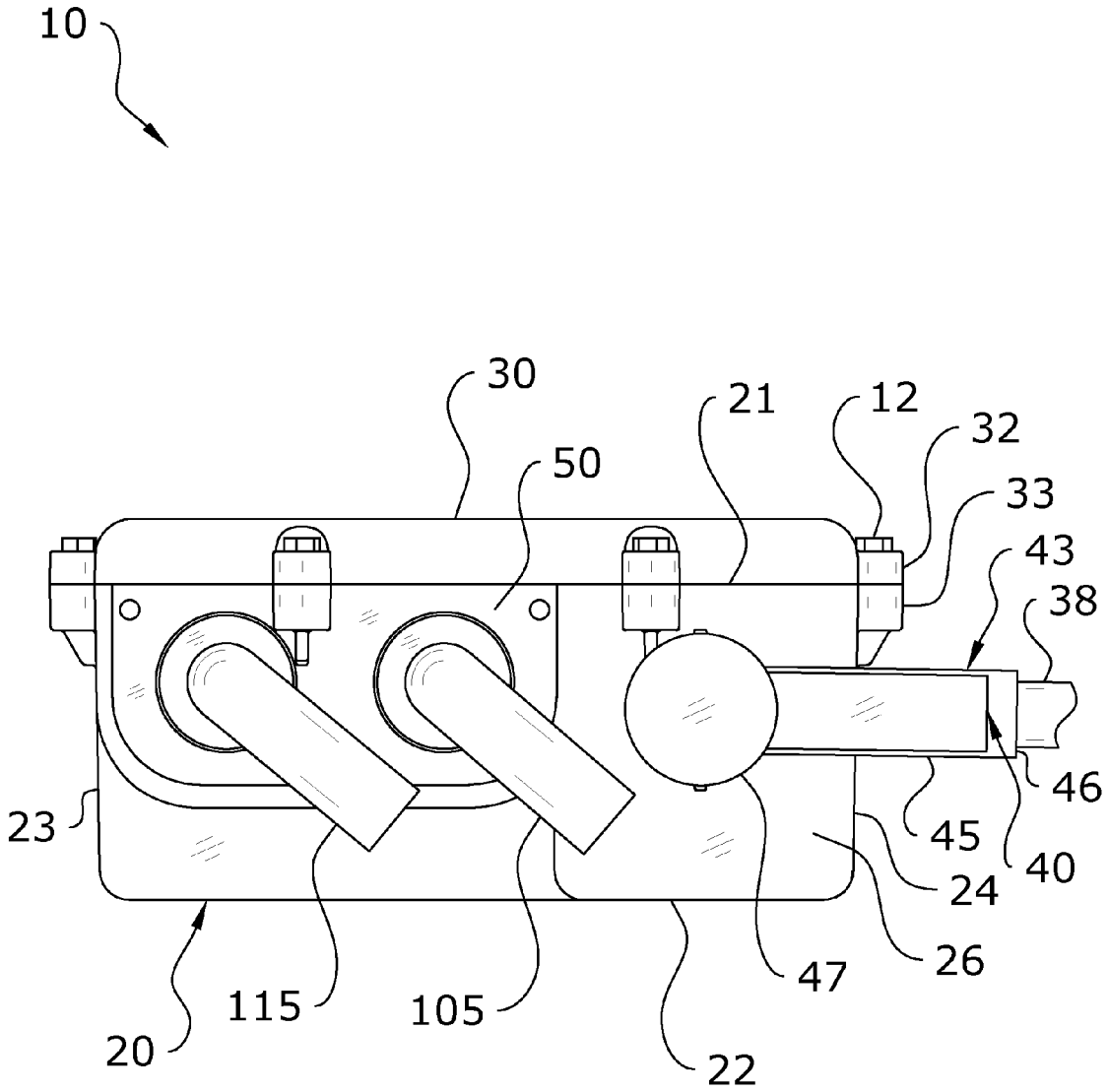
FIG. 12 is a second side view of the present invention.
Figure 13:
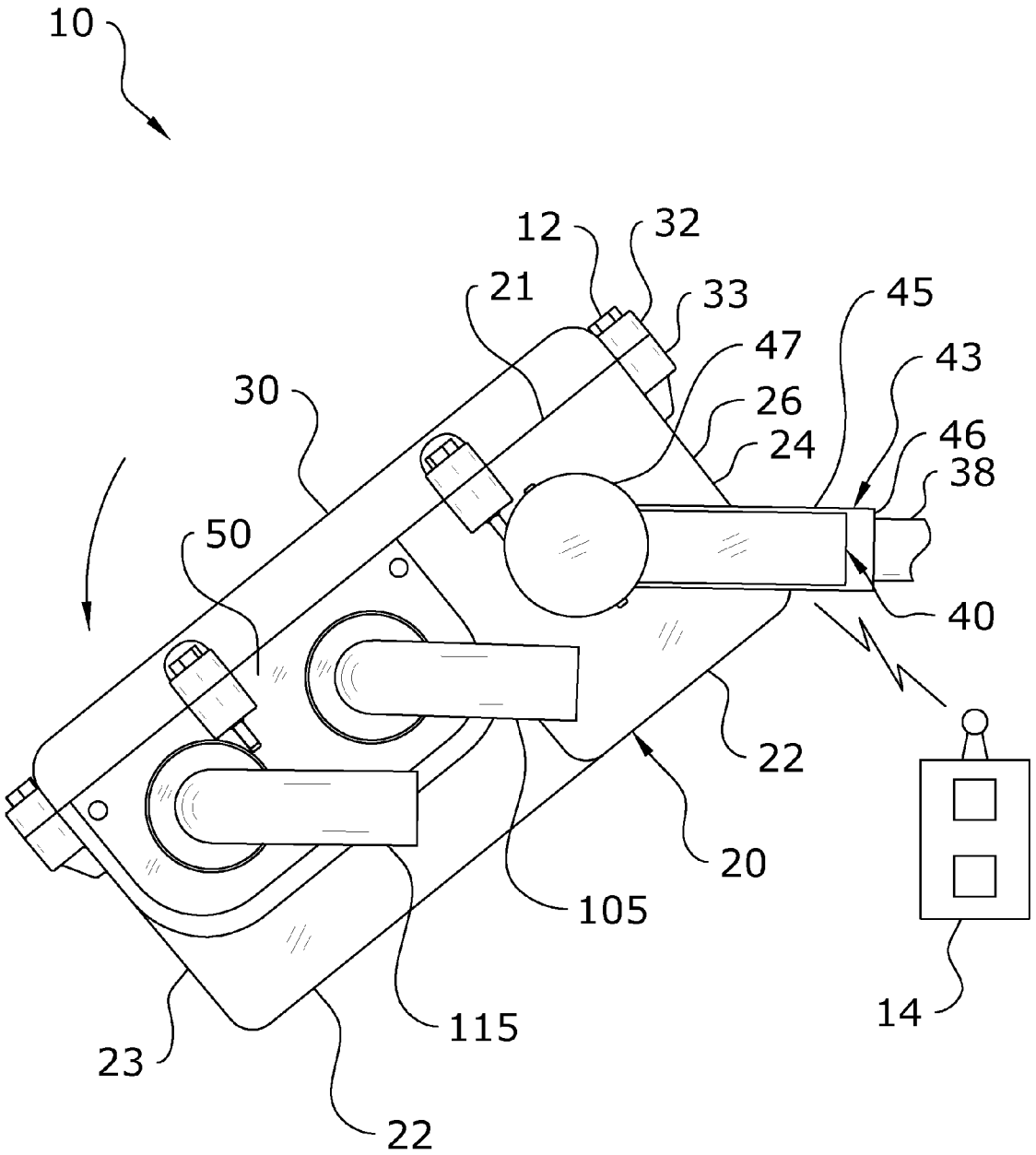
FIG. 13 is a side view of the present invention in a diagonal position.
Figure 14:
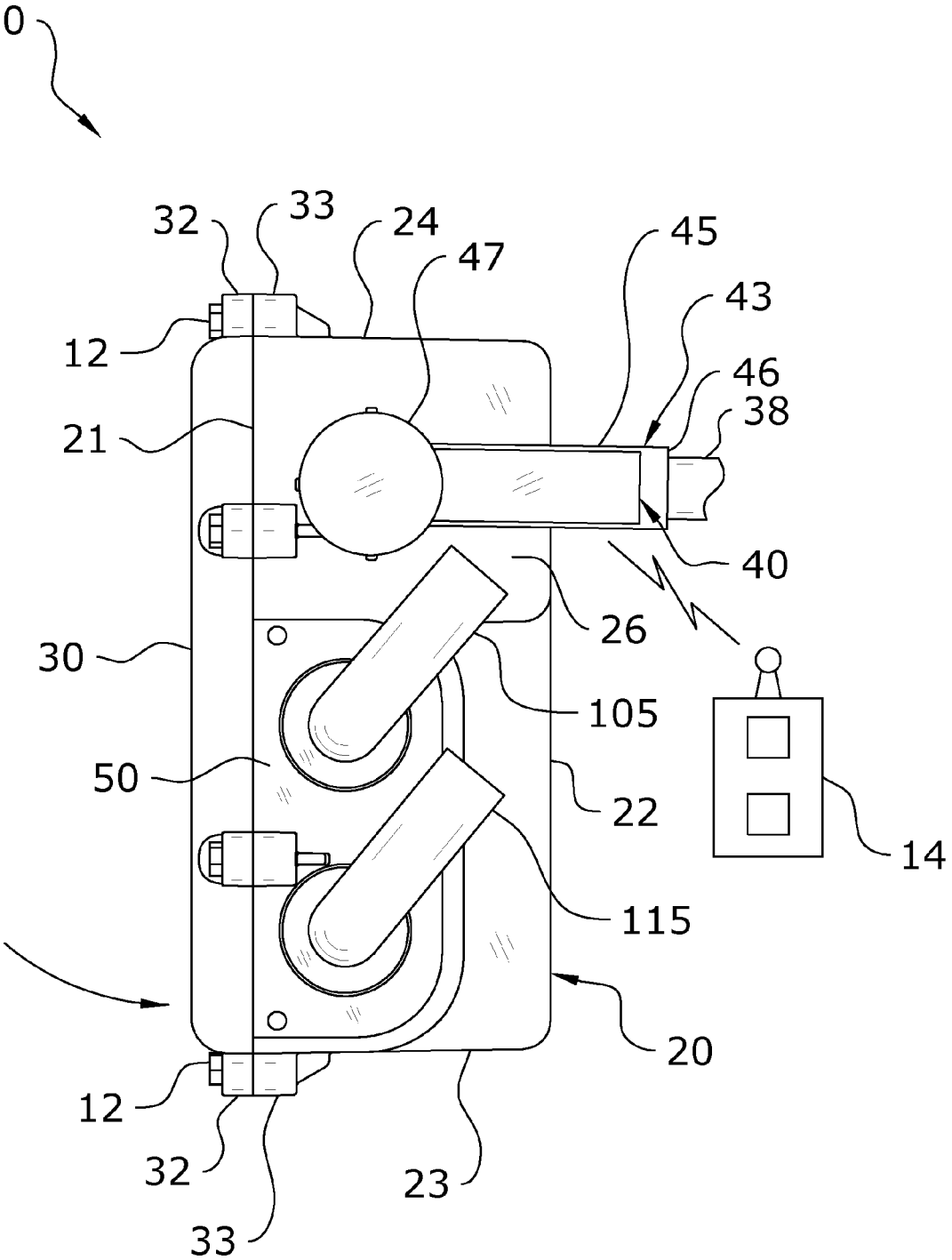
FIG. 14 is a side view of the present invention in a vertical position.
Figure 15:
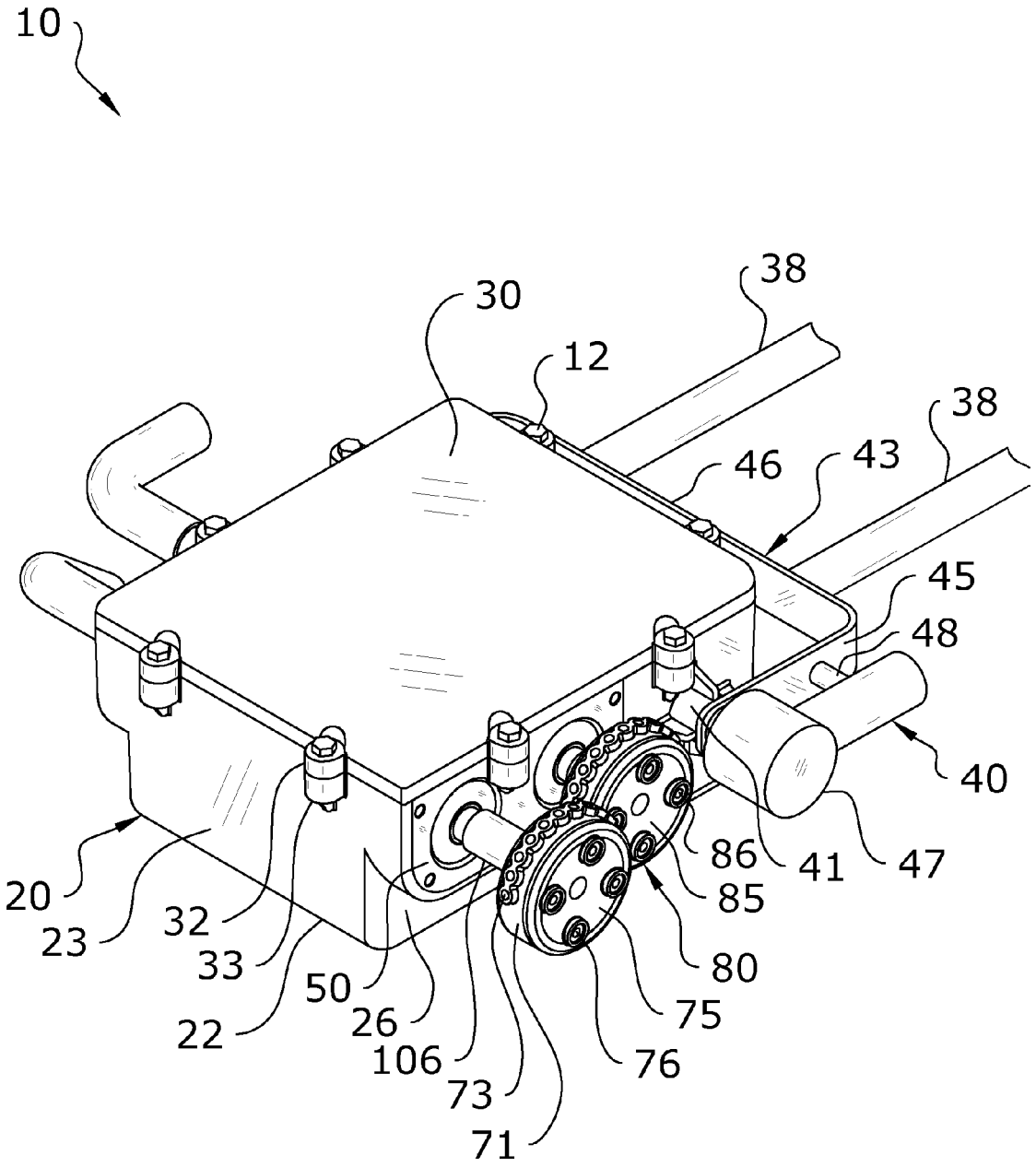
FIG. 15 is an upper perspective view of the present invention ready for use.

As shown in FIGS. 12-14, the housing 20 may include a rotator assembly 40 which is utilized to rotate the housing 20 between a horizontal position, a vertical position, or various positions therebetween. When in a horizontal position, the present invention will spray product in the x-axis position, equally fanned out 180 degrees in a broadcasting manner. When in a vertical position, the present invention may be attached to the end of a boom or platform allowing the housing 20 to be rotated in a y-axis or an up-and-down movement that pivots the alignment of the spray heads 70, 80 for directional placement of product. Further, use of the rotational axis of the housing 20 may enhance the direction of spray for different grades of angle by utilizing the rotator assembly 40 to pivot or rotate the housing 20 into various positions.

As best shown in FIG. 4, the housing 20 includes a rotator bar 43 which is utilized to rotate or pivot the housing 20 into various different positions. The rotator bar 43 may be installed at any location on the housing 20, with a preferred embodiment as shown in the figures having the rotator bar 43 connected across the rear end 24 of the housing 20. The structure, shape, configuration, and orientation of the rotator bar 43 may vary in different embodiments and should not be construed as limited by the exemplary figures.

In the embodiment shown in the figures, the housing 20 includes a first pivot connector 41 on its first side 25 and a second pivot connector 42 on its second side 26. The pivot connectors 41, 42 may be comprised of any structure or device capable of rotating the rotator bar 43. In the embodiment shown in the figures, the first pivot connector 41 is positioned on the first side 25 of the housing 20 near its rear end 24 and the second pivot connector 42 is positioned on the second side 26 of the housing 20 near its rear end 24.

The first side 44 of the rotator bar 43 rotatably or pivotably connects to the first pivot connector 41 and the second side 45 of the rotator bar 43 rotatably or pivotably connects to the second pivot connector 42. A cross portion 46 extends between the first side 44 and second side 45 of the rotator bar 43, with the cross portion 46 extending parallel with respect to the rear end 24 of the housing 20.

When in the horizontal position such as shown in FIG. 2, the cross portion 46 extends across the face of the rear end 24 of the housing 20. When in the vertical position, the cross portion 46 extends across the face of the lower end 22 of the housing 20 as shown in FIG. 12 or across the face of the lid 30 of the housing 20, depending on the direction of rotation.

As best shown in FIG. 2, the rotator assembly 40 includes a motor 47 for rotating the housing 20 between various positions. Various types of motors 47 may be utilized, such as but not limited to electric, gas, or hydraulic motors. The drive shaft 49 of the motor 47 is connected to the distal end of the first side 44 or the second side 45 of the rotator bar 43 so that the rotator bar 43 will rotate or pivot upon rotation of the drive shaft 49. A fixed connector 48 connects the motor 47 to the first side 44 or the second side 45 of the rotator bar 43 at a position which is spaced-apart from the drive shaft 49 such as shown in FIG. 2 to provide the lift necessary to rotate or pivot the housing 20.

D. Port Mounts

As shown throughout the figures and best illustrated in FIG. 6, the present invention includes a pair of removable and interchangeable port mounts 50, 60 which are selectively installed within the receiver openings 28, 29 of the housing 20. In the embodiment illustrated in the figures, the present invention includes a first port mount comprising an inlet port mount 50 and a second port mount comprising an outlet port mount 60.

Each of the port mounts 50, 60 will generally be the same configuration as the other so that they are easily interchangeable between the receiver openings 28, 29 of the housing 20. The shape, size, configuration, orientation, and dimensions of the port mounts 50, 60 may vary for different embodiments of the present invention. The port mounts 50, 60 should be configured to fit securely within either of the receiver openings 28, 29. In the embodiment shown in the figures, the port mounts 50, 60 each comprise substantially rectangular configurations.

As shown in FIG. 5, the inlet port mount 50 includes a first inlet port 52 and a second inlet port 53 formed within its body, with the first inlet port 52 being separate from the second inlet port 53. The outlet port mount 60 similarly includes a first outlet port 62 and a second outlet port 63, with the first outlet port 62 being separate from the second inlet port 64. The inlet ports 52, 53 are adapted to receive supply hoses 105, 115 and the outlet ports 60, 62 are adapted to receive outlet connectors 106, 116. Although the figures illustrate that the inlet ports 52, 53 and outlet ports 62, 63 are respectively horizontally-offset, it should be appreciated that they could be vertically-offset or diagonally-offset in other embodiments.

It should be appreciated that, structurally, the inlet port mount 50 and the outlet port mount 60 are preferably the same. Thus, the term "inlet port mount" will refer to the port mount 50 which is connected to the supply hoses 105, 115 and the term "outlet port mount" will refer to the port mount 60 to which the outlet connector 106, 116 is connected. Other than the receiver opening 28, 29 to which the port mounts 50, 60 are connected, there is no structural difference between the inlet port mount 50 and the outlet port mount 60 as they are interchangeable.

It is important that the housing 20 of the present invention be sealed to prevent ingress or egress of fluids. Thus, a first mount seal 55 is utilized to seal the interconnection between the inlet port mount 50 and the first receiver opening 28. Similarly, a second mount seal 65 is utilized to seal the interconnection between the outlet port mount 60 and the second receiver opening 29.

Each of the ports 52, 53, 62, 63 also includes their own port seal 57, 58, 67, 68. Thus, the first inlet port 52 includes a first inlet port seal 57, the second inlet port 53 includes a second inlet port seal 58, the first outlet port 62 includes a first outlet port seal 67, and the second outlet port 63 includes a second outlet port seal 68. Various types of seals 57, 58, 67, 68 may be utilized, with the figures illustrating the usage of O-ring seals such as shown in FIG. 6.

The port mounts 50, 60 may be removably secured to the housing 20 in its receiver openings 28, 29 through various connectors, linkages, and the like. In a preferred embodiment as shown in the figures, fasteners 12 may be utilized to secure the connection. As shown in FIG. 5, the port mounts 50, 60 may also include housing connectors 33 which are interconnected selectively with accompanying lid connectors 32 on the lid 30.

E. Spray Heads

As shown throughout the figures, the present invention utilizes oscillating, offset spray heads 70, 80 which extend out of the housing 20 to apply a product to a well-defined area. The spray heads 70, 80 are best illustrated in FIG. 6. The first spray head 70, which is adapted to extend from the first outlet port 62, comprises a circular configuration having a first flange 71 on its outer circumference and a central opening 72 at its approximate center.

Figure 7:
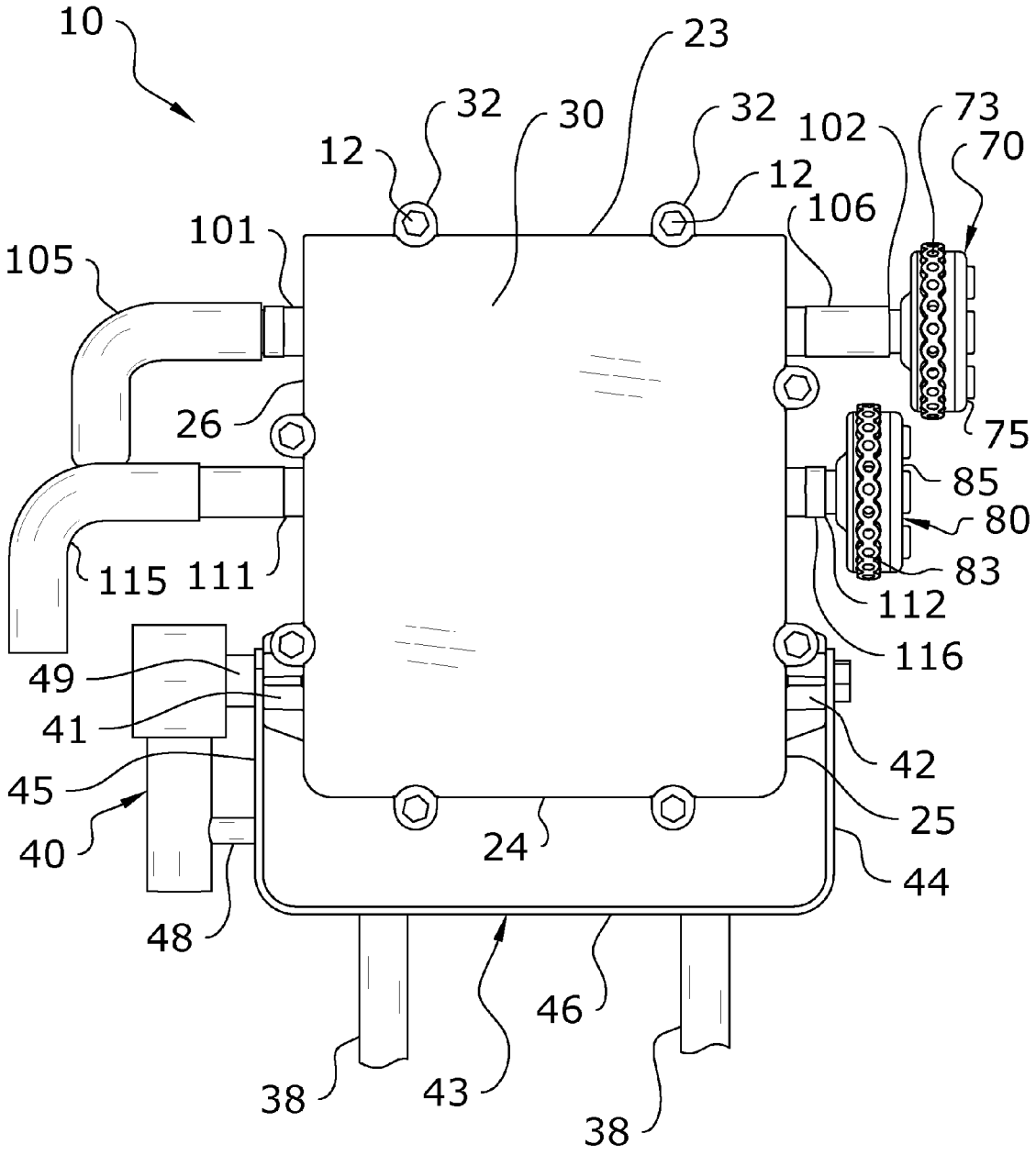
FIG. 7 is a top view of the present invention.

Extending from the outer circumference of the first spray head 70 are a plurality of first outer sprayers 73 as shown in FIG. 7. The product is dispensed through the first outer sprayers 73 as the first spray head 70 is oscillated. The first outer sprayers 73 may cover the entire outer circumference of the first spray head 70 or may only cover a portion of the outer circumference of the first spray head 70 as shown in the figures.

The first spray head 70 may include a removable first spray cover 75 to allow the first spray head 70 to be easily serviced if necessary. The first spray head 70 thus includes one or more first cover receivers 74 extending from its body which are adapted to removably connect to corresponding first cover connectors 76 on the first spray cover 75, which is removably secured over the first spray head 70. A first cover seal 77, comprised of an O-ring seal, is shown in FIG. 6 to seal the interconnection between the first spray head 70 and the first spray cover 75.

The second spray head 80, which is adapted to extend from the second outlet port 63, comprises a circular configuration having a second flange 81 on its outer circumference and a central opening 82 at its approximate center. Extending from the outer circumference of the second spray head 80 are a plurality of second outer sprayers 83 as shown in FIG. 7. The product is dispensed through the second outer sprayers 83 as the second spray head 80 is oscillated. The second outer sprayers 83 may cover the entire outer circumference of the second spray head 80 or may only cover a portion of the outer circumference of the second spray head 80 as shown in the figures.

The first spray head 70 and the second spray head 80 each oscillate between a first position and a second position. The spray heads 70, 80 each oscillate by rotating in a first rotational direction towards the first position, then rotate in a second rotational direction towards the second position, then rotate again in the first rotational direction towards the first position and so forth in an oscillating manner. The amount of rotation and the speed of rotation for each of the spray heads 70, 80 may vary depending upon the application and conditions. For example, the spray heads 70, 80 may rotate 360 degrees, 300 degrees, 200 degrees, 90 degrees, 45 degrees and the like.

The second spray head 80 may include a removable second spray cover 85 to allow the second spray head 80 to be easily serviced if necessary. The second spray head 80 thus includes one or more second cover receivers 84 extending from its body which are adapted to removably connect to corresponding second cover connectors 86 on the second spray cover 85, which is removably secured over the second spray head 80. A second cover seal 87, comprised of an O-ring seal, is shown in FIG. 6 to seal the interconnection between the second spray head 80 and the second spray cover 85.

The positioning of the spray heads 70, 80 may vary, but they will preferably overlap each other at least partially to improve accuracy and efficiency of product distribution. Thus, the spray heads 70, 80 are preferably staggered such that they are not concentric. The spray heads 70, 80 preferably have portions that overlap with the second spray head 80 positioned behind the first spray head 70 without the spray heads 70, 80 having a common axis such as shown in FIG. 7.

F. Motor and Internal Conduits

As best shown in FIGS. 4, 8, 9, and 10, the interior of the housing 20 includes a motor mount 90 in which a motor 91 is secured. The motor 91 is utilized to provide oscillating or rotating force to the spray heads 70, 80 of the present invention. Preferably, the first spray head 70 will oscillate or rotate in a first direction while the second spray head 80 will oscillate or rotate in a second direction. Various types of motors 91 may be utilized, such as hydraulic, electric, gas, and the like. The scope of the present invention should not be construed as limited to any particular type of motor 91.

Figure 8:
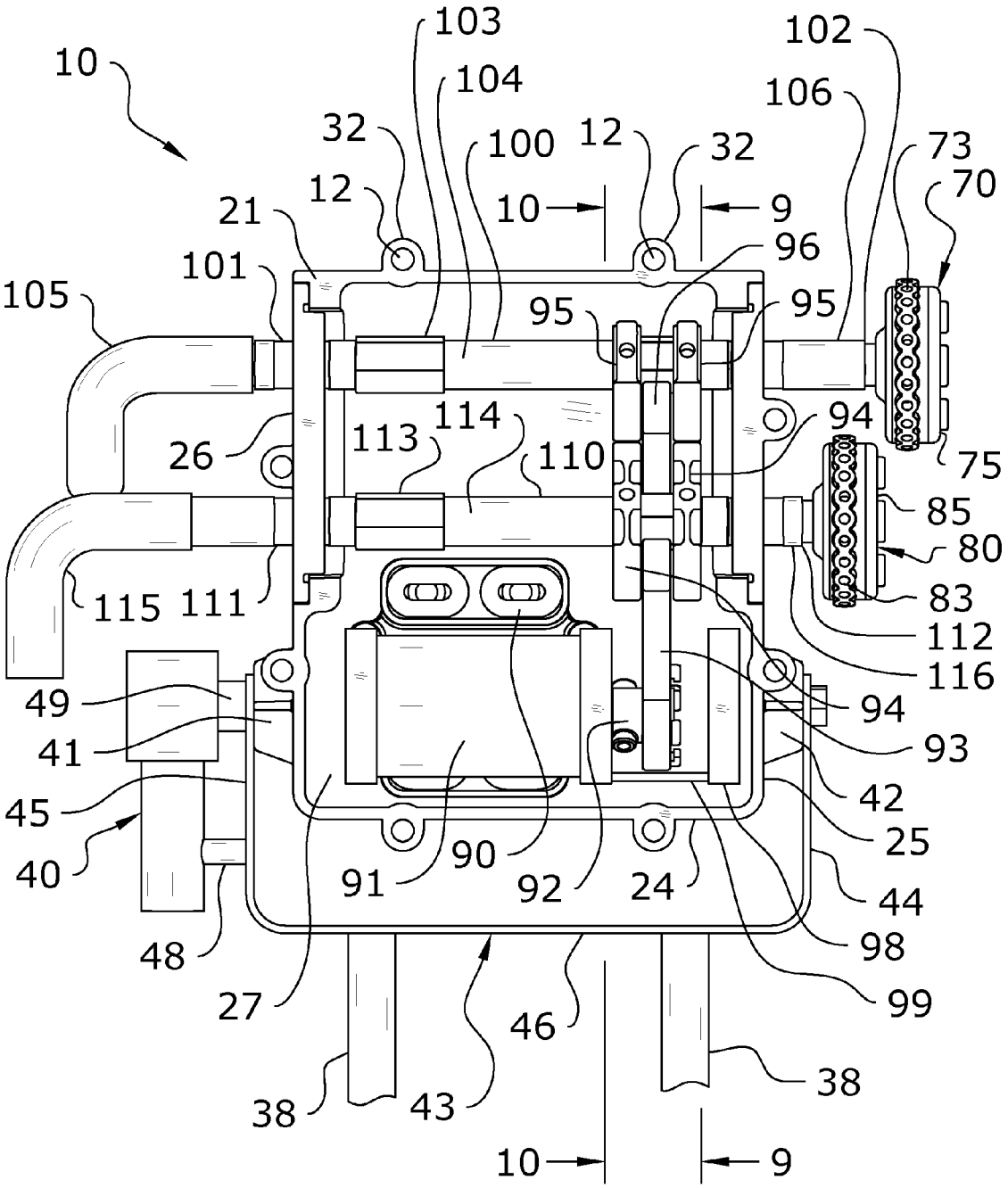
FIG. 8 is a top view of the present invention with the lid removed.
Figure 9:
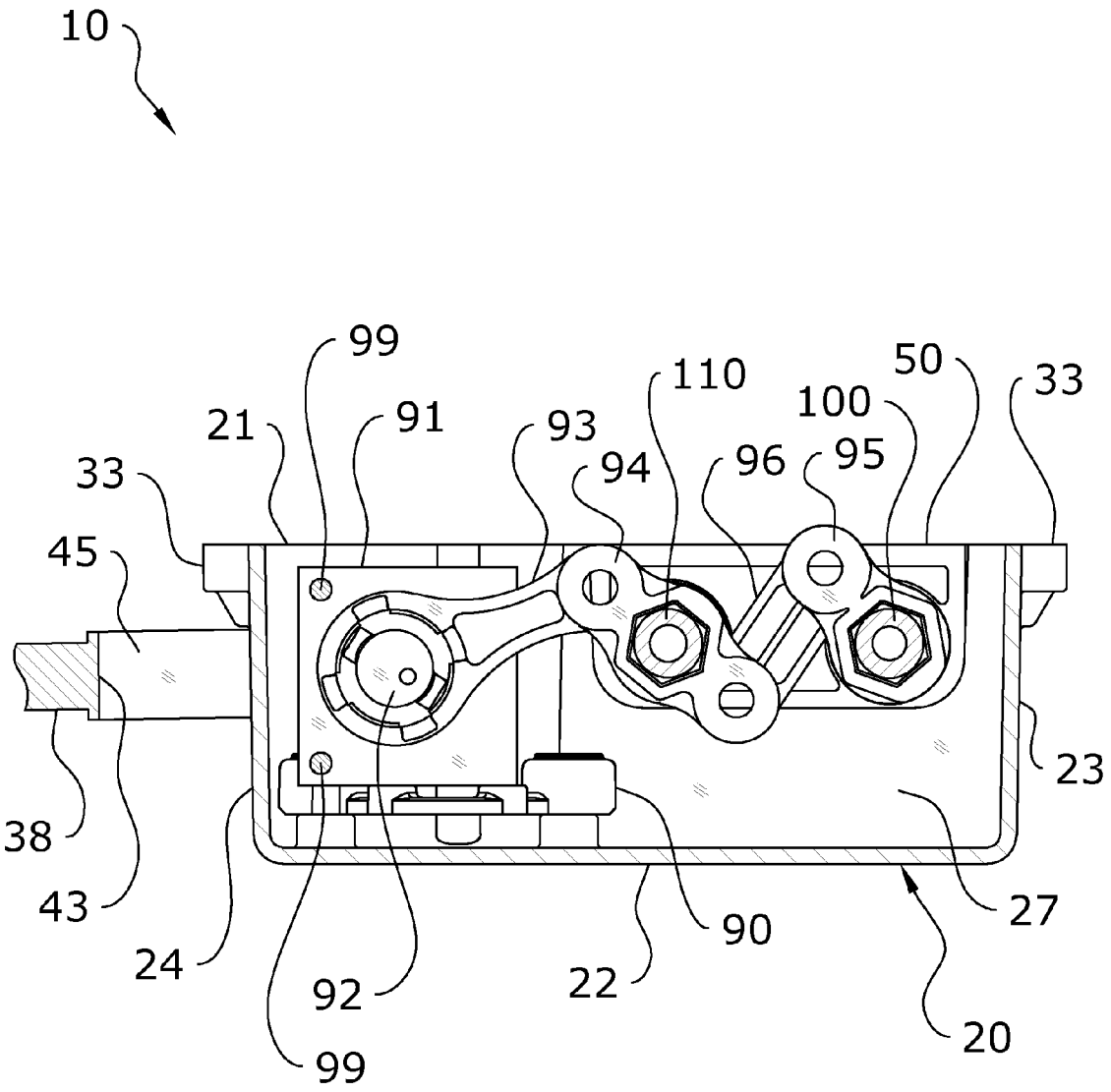
FIG. 9 is a first side sectional view of the present invention.
Figure 10:
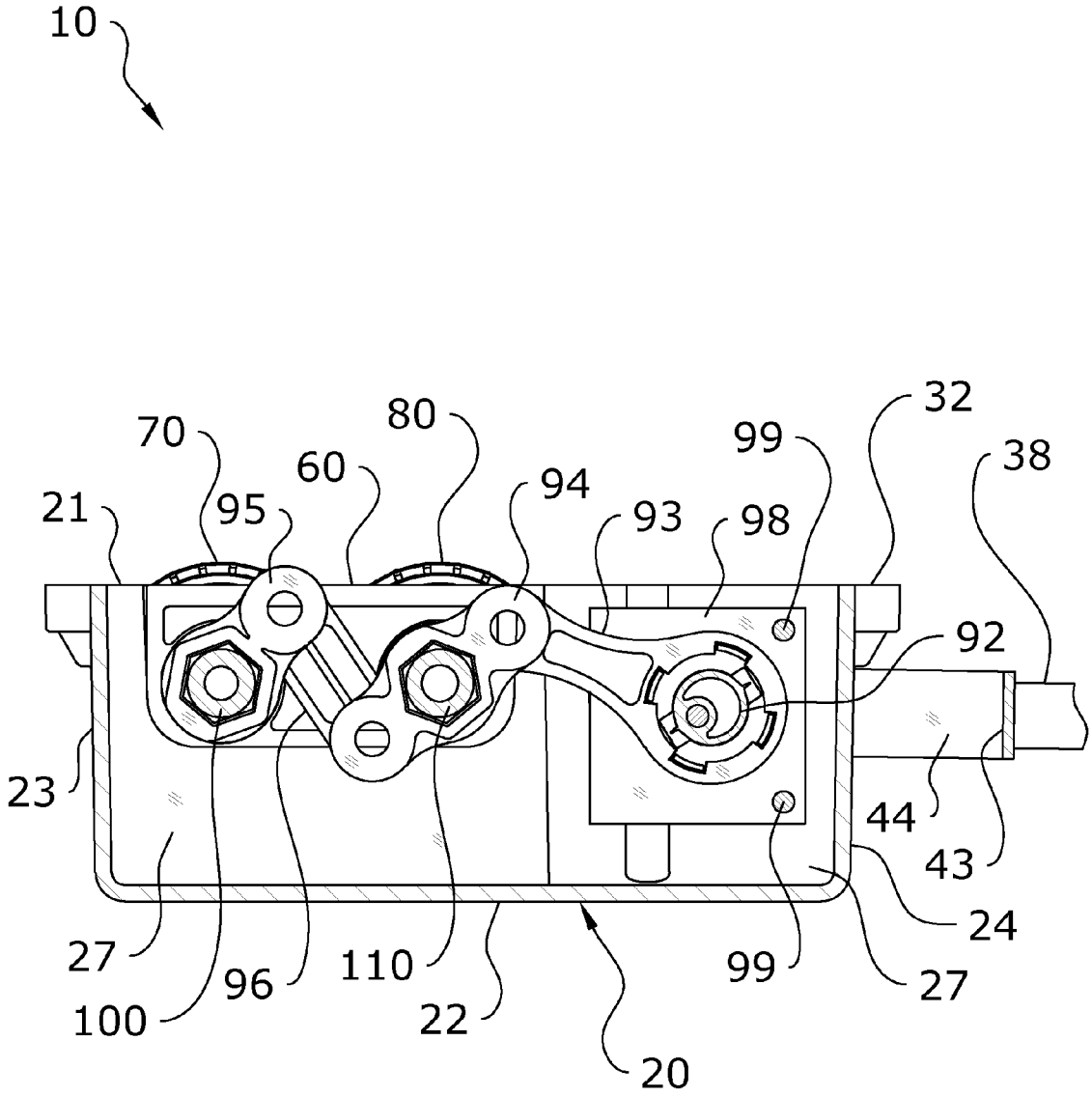
FIG. 10 is a second side sectional view of the present invention.
Figure 11:
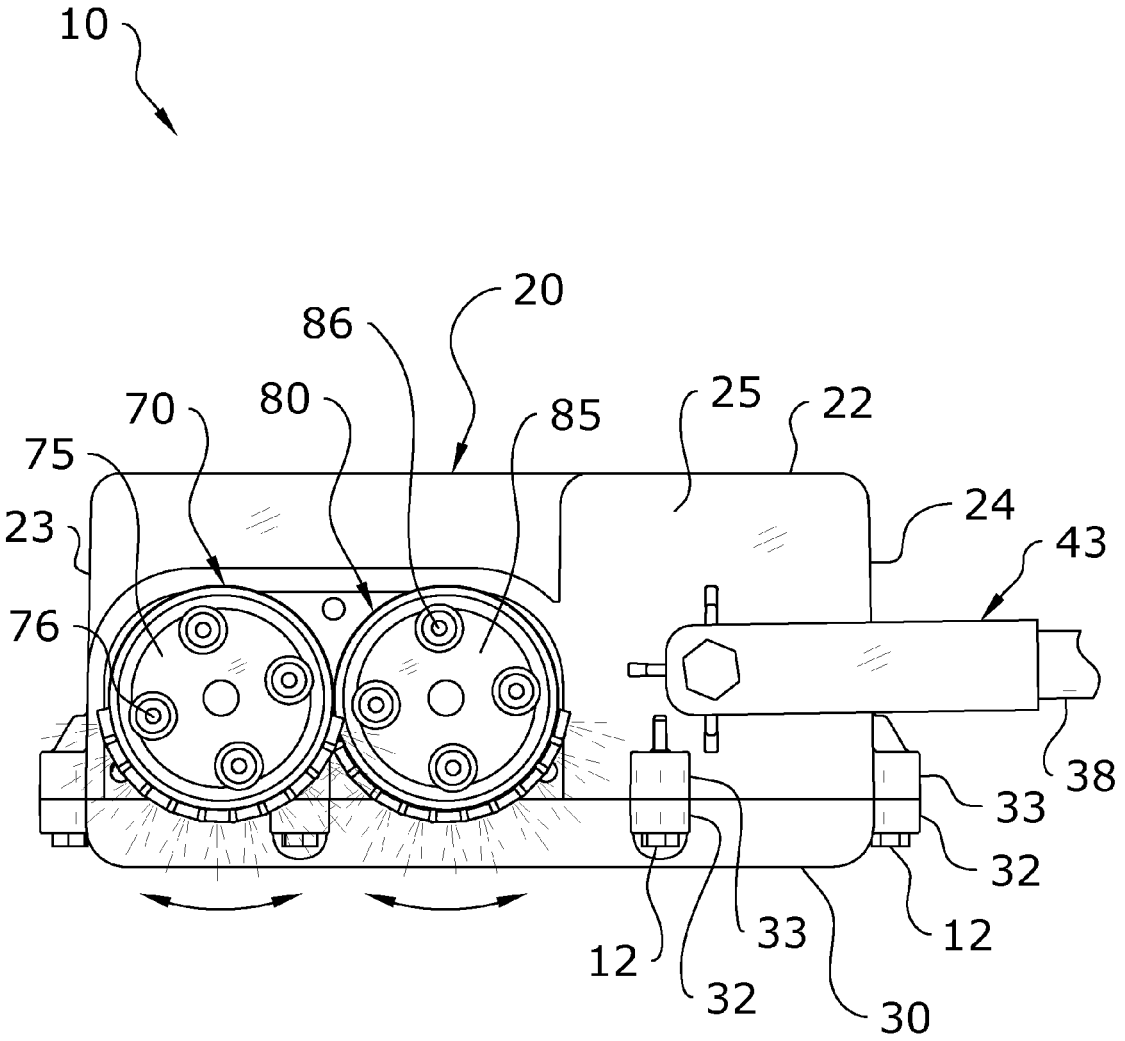
FIG. 11 is a first side view of the present invention.

As best shown in FIG. 8, the motor shaft 92 extends out of the motor 91. The motor shaft 92 will rotate or oscillate when the present invention is in use. As shown in FIGS. 9 and 10, linkages 93, 96 and connectors 95, 96 are utilized to transfer the force from the motor shaft 92 to the conduits 100, 110 so as to rotate or oscillate the spray heads 70, 80. Various configurations may be utilized, and the scope of the present invention should not be limited to the exemplary figures which merely illustrate one embodiment of the force transfer between the motor 91 and the spray heads 70, 80.

In the preferred embodiment shown in FIGS. 8-10, a first linkage 93 is connected to the motor shaft 92, such as in a perpendicular orientation as shown in the figures. The first linkage 93 may comprise a belt, rod, or other type of linkage 93 which extends between the motor shaft 92 and the first connector 94 of the present invention.

The first connector 94 may comprise a cam crank, double-ended rod, or the like which is connected around the second internal conduit 110 as shown in FIG. 9. A first end of the first connector 94 is connected to the first linkage 93 while a second end of the first connector 94 is connected to a second linkage 96. Thus, the rotational force will be transferred from the motor shaft 92, through the first linkage 93, to the first connector 94, where the force is applied to the second internal conduit 110.

The second linkage 96 extends between the first connector 94 and a second connector 95. The second linkage 96 may comprise a belt, rod, or other type of linkage 96 which extends between the first and second connectors 94, 95 to link them together. A first end of the second linkage 96 is connected to the first connector 94 and a second end of the second linkage 96 is connected to the second connector 95.

As shown in FIG. 9, the second connector 95 may comprise a cam crank, double-ended rod, or the like which is connected around the second internal conduit 100 as shown in FIG. 9. A first end of the first connector 95 is connected to the second linkage 96. Rotational force will be transferred from the first connector 94, through the second linkage 96, to the second connector 95, where the force is applied to the first internal conduit 100.

Preferably, the linkages 93, 96 and connectors 94, 95 are arranged such that the first internal conduit 100 rotates or oscillates in a first direction while the second internal conduit 110 rotates or oscillates in a second direction. Other arrangements may be utilized in different embodiments, however, as this is merely one exemplary embodiment of the present invention.

As shown in FIG. 8, a motor block 98 may be provided to relieve pressure from the end of the motor shaft 92. The motor block 98 is connected around the motor shaft 92 by one or more rods 99 which extend between the motor 91 and the motor block 98. Various types of motor blocks 98 may be utilized and, in some embodiments, the motor block 98 may be omitted entirely.

Product to be dispensed by the spray heads 70, 80 will generally enter the housing 20 through the inlet ports 52, 53 and exit the housing 20 through the outlet ports 60, 62. As shown throughout the figures, supply hoses 105, 115 are utilized to feed the product into the housing 20. The supply hoses 105, 115 are fluidly connected to a source of product, such as a reservoir containing water or some other type of product. A first supply hose 105 connects the product source with the first inlet port 52 of the housing 20 and a second supply hose 115 connects the product source with the second inlet port 53 of the housing 20. The supply hoses 105, 115 should be removably connected to the inlet ports 52, 53 so that they may be freely interchangeable.

The product traverses through the housing 20 using a pair of internal conduits 100, 110, with the first internal conduit 100 connecting the first supply hose 105 with the first spray head 70 and the second supply hose 115 with the second spray head 80. The first internal conduit 100 includes a first inlet 101 which connects removably to the first supply hose 105 and the second internal conduit 110 includes a second inlet 111 which connects removably to the second supply hose 115.

Each of the internal conduits 100, 110 includes a bearing 103, 113 which allows rotation of a pair of reciprocating portions 104, 114, with the first internal conduit 100 having a first reciprocating portion 104 and the second internal conduit 110 having a second reciprocating portion 114. Thus, the first internal conduit 100 will generally have a first bearing 103, 113 between its inlet 101 and its outlet 102 and the second internal conduit 110 will generally have a second bearing 113 between its inlet 111 and its outlet 112. The bearing 113 will impart rotational force from the motor 91 to the reciprocating portions 104, 114 of the respective internal conduits 100, 110 so produce the oscillating force of the spray heads 70, 80.

The reciprocating portions 104, 114 of the each internal conduit 100, 110 includes an outlet connector 106, 116 to which the spray heads 70, 80 may be removably and interchangeably connected. Thus, the first internal conduit 100 includes a first outlet connector 106 at its first outlet 102 and the second internal conduit 110 includes a second outlet connector 116 at its second outlet 112. The first outlet connector 106 may include first threading 107 for removably connecting the first spray head 70 and the second outlet connector 116 may include second threading 117 for removably connecting the second spray head 80.

G. Operation of Preferred Embodiment

In use, the housing 20 is first assembled to the proper configuration for the type of application being performed. The inlet port mount 50 will be secured within the first receiver opening 28 and the outlet port mount 60 will be secured within the second receiver opening 29. The positioning of the inlet and outlet port mounts 50, 60 will depend on which side 25, 26 of the housing 20 the spray heads 70, 80 should extend from.

With the port mounts 50, 60 secured to the housing 20, the supply hoses 105, 115 may be connected to the housing 20. The first supply hose 105 connects to the first inlet port 52 and the second supply hose 115 connects to the second inlet port 53. The first supply hose 105 may then be connected to a product source such as a reservoir to feed the inlet ports 52, 53.

With the supply hoses 105, 115 connected to the first side 25 of the housing 20, the spray heads 70, 80 may be secured to the second side 26 of the housing 20. The first spray head 70 is removably secured to the first outlet port 62 by connecting the first spray head 70 to the first threading 107 of the first outlet connector 106. The second spray head 80 is removably secured to the second outlet port 63 by connecting the second spray head 80 to the second threading 117 of the second outlet connector 116.

With the housing 20 fully assembled and ready to apply product, the housing 20 may be placed at the location where the product is to be applied. The housing 20 may simply be placed to sit at the location or may be connected to a vehicle such as a tractor or the like. The housing 20 may be positioned on a mobile or stationary platform. As shown throughout the figures, boom connectors 38 may extend from the rotator bar 47 to connect the housing 20 to a boom to aid in connecting the housing 20 with various other vehicles, structures, platforms, or devices or for elevated operations.

With the housing 20 in position, the orientation of the housing 20 may be adjusted using the rotator assembly 40. As shown in the figures, the housing 20 may be adjusted between a horizontal orientation, a vertical orientation, and various diagonal orientations. A remote 14 may be utilized to remotely control the rotator motor 47 and thus adjust orientation of the housing 20 from a remote location.

With the housing 20 oriented properly, the spray heads 70, 80 and motor 91 may be activated. Product flows from the product source, into the housing 20 via the inlet ports 52, 53, through the internal conduits 100, 110, and out of the outlet ports 62, 63 to be dispensed by the spray heads 70, 80. The product streams are broken into specific-sized droplets by the oscillation of the spray heads 70, 80. The spray heads 70, 80 are preferably mounted in an overlapping distribution pattern, with each spray head 70, 80 having changeable sprayer nozzles 73, 83 which allow alternate spray patterns for specific requirements. The extruded product droplets are uniform in size, thus eliminating 60K micron-sized product particles inhibiting off target drift.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A product applicator system, comprising:

a housing;

a first spray head connected to said housing;

a second spray head connected to said housing;

a first internal conduit within said housing and a second internal conduit within said housing, wherein said first spray head is connected to said first internal conduit and wherein said second spray head is connected to said second internal conduit;

a motor for rotating said first spray head and said second spray head;

a motor shaft extending out of said motor;

a first connector secured around said first internal conduit; and a second connector secured around said second internal conduit, wherein a first linkage connects said motor shaft with said first connector and wherein a second linkage connects said second connector with said first connector.

2. The product applicator system of claim 1, further comprising a rotator assembly for rotating said housing between a plurality of orientations.

3. The product applicator system of claim 2, wherein said plurality of orientations comprise a horizontal orientation and a vertical orientation.

4. The product applicator system of claim 2, wherein said rotator assembly comprises a rotator bar extending across said housing, wherein said rotator bar is rotatable to adjust said orientation of said housing.

5. The product applicator system of claim 4, wherein said rotator assembly includes a rotator motor.

6. The product applicator system of claim 1, wherein said first spray head and said second spray head are adapted to oscillate.

7. The product applicator system of claim 6, wherein said motor oscillates said first spray head and said second spray head.

8. The product applicator system of claim 1, wherein said housing includes an inlet port mount and an outlet port mount.

9. The product applicator system of claim 8, wherein said inlet port mount is removably connected to a first receiver opening of said housing.

10. The product applicator system of claim 9, wherein said outlet port mount is removably connected to a second receiver opening of said housing.

11. The product applicator system of claim 8, wherein said outlet port mount includes a first outlet port and a second outlet port.

12. The product applicator system of claim 11, wherein said first spray head is removably connected to said first outlet port and wherein said second spray head is removably connected to said second outlet port.

13. The product applicator system of claim 12, wherein said inlet port mount includes at least one inlet port.

14. The product applicator system of claim 13, further comprising at least one supply hose removably connected to said at least one inlet port.

15. The product applicator system of claim 1, wherein said first spray head includes a plurality of first outer sprayers.

16. The product applicator system of claim 15, wherein said first outer sprayers extend around at least half an outer circumference of said first spray head.

17. The product applicator system of claim 1, wherein said first spray head and said second spray head overlap.

18. The product applicator system of claim 17, wherein said second spray head is positioned behind said first spray head.

* * * * *